United States Patent [19]

Foshée

[11] Patent Number: 4,633,690

[45] Date of Patent: Jan. 6, 1987

[54] CYLINDER ANCHOR

[75] Inventor: William R. Foshée, Noblesville, Ind.

[73] Assignee: Best Lock Corporation, Indianapolis, Ind.

[21] Appl. No.: 733,120

[22] Filed: May 13, 1985

[51] Int. Cl.[4] ..... E05B 9/08

[52] U.S. Cl. ..... 70/451; 70/370

[58] Field of Search ..... 70/450, 451, 452, 370

[56] References Cited

U.S. PATENT DOCUMENTS

| | | | |
|---|---|---|---|
| 629,630 | 7/1899 | Voight | 70/370 |
| 900,620 | 10/1908 | Voight | 70/370 |
| 1,501,315 | 7/1924 | Dement | 70/370 |
| 1,505,524 | 8/1924 | Augenbraun | 70/370 |
| 1,561,771 | 11/1925 | Best | 70/370 |
| 1,629,172 | 5/1927 | Murphy | 70/370 |
| 1,889,454 | 11/1932 | Shaw | 70/370 |
| 2,633,011 | 3/1953 | Poupitch | 70/370 |
| 3,455,129 | 7/1969 | Forbes et al. | 70/370 |
| 3,745,795 | 7/1973 | Sanders | 70/451 |
| 4,296,619 | 10/1981 | Widen | 70/451 |

FOREIGN PATENT DOCUMENTS

| | | | |
|---|---|---|---|
| 989904 | 5/1976 | Canada | 70/451 |
| 166514 | 10/1921 | United Kingdom | 70/370 |

*Primary Examiner*—Gary L. Smith

*Assistant Examiner*—Vinh Luong

*Attorney, Agent, or Firm*—Barnes & Thornburg

[57] ABSTRACT

An improved lock cylinder assembly is mountable in a lock case and includes a lock body having an exterior side wall. The lock cylinder assembly is mountable in the lock case and fixable in a selected position therein by a rotation-blocking side setscrew, and a cylinder-anchoring hidden setscrew. The lock body is formed to include a cavity for the reception of an interchangeable lock core, at least one elongated channel having a longitudinal axis, the central including an opening in the exterior side wall for the reception of the side setscrew, and a bore having a longitudinal axis for the reception of a hidden setscrew. The bore extends between the lock body cavity and the exterior side wall to define an opening in the exterior side wall of the lock body. Each channel opening and the exterior bore opening are situated in circumferentially spaced-apart relation on the exterior side wall of the lock body. Orientation of the bore within the lock body causes the longitudinal bore axis to lie in skewed non-intersecting relation to the longitudinal channel axis. The hidden setscrew is threadably received in the bore and advanceable therethrough to engage lockingly the lock case and thereby anchor the lock cylinder assembly in its mounted position.

14 Claims, 6 Drawing Figures

CYLINDER ANCHOR

This invention relates to locks, and particularly to a lock cylinder anchor for attaching a lock cylinder to a lock case. More particularly, this invention relates to a lock cylinder that has an exterior circumference and that is rigidly fixable to a lock case by means of a rotation-blocking setscrew and a cylinder-anchoring setscrew that is circumferentially spaced-apart in relation to the rotation-blocking setscrew.

Lock cylinders are typically mounted in a lock case to prevent removal by unauthorized persons. It is known to use one type of setscrew to block rotation of the lock cylinder relative to the lock case and another type of setscrew to fix rigidly the lock cylinder in its mounted position in the lock case.

A prior art lock cylinder of the type described above is illustrated in FIG. 1. A known lock cylinder 10 includes a lock body 12 mountable in a frame such as door 14 or a mortise lock case (not shown) by a cylinder-anchoring setscrew 16 and a rotation-blocking setscrew 18. The conventional lock body 12 is formed to include a bore 20 for threadedly receiving the cylinder-anchoring setscrew 16, a channel 22 for receiving a forward tip 24 of the rotation-blocking setscrew 18, and a lock cavity 26 for receiving an interchangeable lock core (not shown). Typically, the bore 20 is formed to have an opening 21 in a channel side wall so that the bore 20 opens into the channel 22 as shown in FIG. 1.

The conventional lock cylinder 10 is installed in the door 14 in the following manner. The lock body 12 is threadedly received in an aperture 15 provided in the door 14 or the like. It is known to position a cylinder ring 17 between the door 14 and the lock body 12 as shown in FIG. 1. The cylinder-anchoring setscrew 16 is then inserted into bore 20 through an opening 23 in an inner wall of the lock body cavity 26 while the lock body cavity 26 is empty and is then rotated to engage a lock case fixture 28 rigidly attached to the door 14 so that the lock body 12 is securely retained in its mounted position. Subsequently, the rotation-blocking setscrew 18 is moved into the channel 22 and then into the exterior opening 21 of bore 20 formed in a side wall of the channel 22 to engage either the cylinder-anchoring setscrew 16 or the bore 20 for the purpose of blocking rotation of the lock body 12 in relation to the lock case fixture 28.

One problem associated with the conventional lock cylinder shown in FIG. 1 has been misalignment of the lock cylinder 10 in relation to the remainder of the lock mechanism (not shown) resulting in partial or total failure of the whole lock assembly. One source of the foregoing problem is the conventional alignment illustrated in FIG. 1 of the bore 20 in relation to the bore 20 to be formed in the channel 22 at or about the point at which the rotation-blocking setscrew 18 is supposed to intercept the channel 22 for the purpose of blocking rotation of the lock cylinder 10 relative to lock case fixture 28 and the remainder of the lock mechanism (not shown).

One troublesome aspect of the above-described merger of the exterior opening 21 of the bore 20 and channel 22 is poor anchoring of the lock body 12 to the lock case fixture 28 due to an interference condition between the two setscrews 16 and 18 during installation of the lock cylinder 10. One effect of poor anchoring is increased likelihood that the lock cylinder 10 will be jimmied from its mounted position due to failure of the cylinder-anchoring setscrew 16 to anchor properly or secure the lock cylinder 10 in relation to the door 14 and to the lock case mounting fixture 28. If, in a first case not illustrated in the drawings, the cylinder- anchoring setscrew 16 is moved to engage locking the lock case fixture 28 prior to movement of the rotation-blocking setscrew 18, then the lock cylinder 10 will be anchored securely and subsequent operation of the rotation-blocking setscrew will not inhibit said locking engagement. This desirable result is obtained since the second setscrew 18 has not yet been moved to a position in which the second setscrew 18 may obstruct movement of the first setscrew 16 toward its lock case fixture-engaging position. However, if in a second case shown in FIG. 1, the rotation blocking setscrew 18 is installed before the cylinder-anchoring setscrew 16, then the rotation-blocking setscrew 18 may undesirably operate to obstruct movement of the cylinder-anchoring setscrew 16 toward its lock case fixture engaging position. In this second case, the rotation-blocking setscrew 18 is able to move a distance into the bore 20 due to the merger of the bore 20 and the channel 22 at the bore opening. Thus, the rotation-blocking setscrew 18 penetrates the bore 20 to block radially outward travel of the cylinder-anchoring setscrew 16 and to prevent effectively the cylinder-anchoring setscrew 16 from firmly engaging the lock case fixture 28.

Another undesirable aspect of the merger of bore 20 and channel 22 illustrated in FIG. 1 is disunion of the rotation-blocking setscrew 18 from its mounting fixture 30. Disunion can occur if the rotation-blocking setscrew is too short or if the setback of the mounting fixture 30 in relation to the lock body 12 is too far. One effect of disunion is a failure of the rotation-blocking setscrew 18 to block properly rotation of the lock cylinder 10. Although neither of the foregoing disabling conditions are explicitly illustrated in Fig. 1, they can nonetheless be described using the elements shown in FIG. 1. In the first instance, a lock cylinder 10 of the type shown in FIG. 1 is retrofitted into a lock case provided with a short rotation-blocking setscrew (not shown) that has a much shorter length than the illustrated rotation-blocking setscrew 18. In the second instance, a lock cylinder of the type shown in FIG. 1 is retrofitted into a lock case provided with a mounting fixture (e.g. similar to fixture 30) for reception of the rotation-blocking setscrew having a setback that is somewhat larger than an original equipment manufacture lock case designed to receive said lock cylinder. In both of the foregoing cases, the rotation-blocking setscrew may disengage its own mounting fixture before the forward tip of said setscrew engages the lock body 12 thereby causing said setscrew to fall away to a non-rotation-blocking position.

One object of the present invention is to provide a lock cylinder having its cylinder-anchoring setscrew-receiving bore spaced-apart from its companion rotation-blocking setscrew-receiving channel to prevent misalignment of the lock cylinder. Unwanted misalignment can be the result of a lock-disabling setscrew interference condition permitted by merger of the exterior opening of the bore for receiving a cylinder-anchoring setscrew and the channel for receiving a rotation-blocking setscrew.

Another object is to provide a lock cylinder that is easily retrofittable into every lock case regardless of either the length of the rotation-blocking setscrew or the setback of the mounting fixture for the rotation-blocking setscrew in relation to the lock cylinder.

According to the present invention, a lock cylinder assembly includes a lock body having an exterior side wall. The lock cylinder assembly is mountable in a lock case and fixable in a selected position therein by means of a rotation-blocking side setscrew and a cylinder-anchoring hidden setscrew. The lock body is formed to include a cavity for the reception of an interchangeable lock core, at least one channel having an elongated opening in the exterior side wall for the reception of the rotation-blocking side setscrew, and a bore for the reception of the cylinder-anchoring hidden setscrew. The bore extends between the lock body cavity and the exterior side wall to define an opening in the exterior side wall of the lock body. The exterior bore opening and each channel opening are situated in circumferentially spaced-apart relation on the exterior side wall of the lock body. The hidden setscrew is threadedly received in the bore and advanceable therethrough to engage lockingly the lock case.

One advantageous feature of the present invention is the separation of the channel opening and the exterior bore opening so that the side setscrew is movable to engage only the lock body channel without penetrating the exterior bore opening. Separation of the channel and bore openings permit the hidden setscrew to engage firmly the lock case and the side setscrew to engage firmly the lock body resulting in secure retention of the lock cylinder in its mounted position. Thus, an unauthorized person is advantageously prevented from removing a lock cylinder from its mounted position and replacing it with another lock cylinder in order to defeat the security of a master keyed lock system.

Further objects, features, and advantages of the present invention will become more apparent from the following description when taken with the accompanying drawings which show, for purpose of illustration only, an embodiment in accordance with the present invention.

Figure 2:
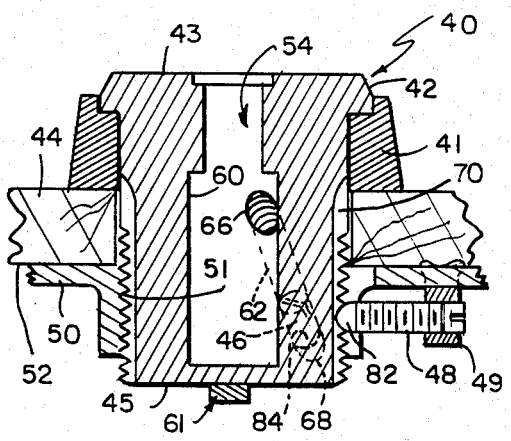
FIG. 2 is a sectional view of a lock cylinder assembly showing an embodiment of the present invention.
Figure 3:
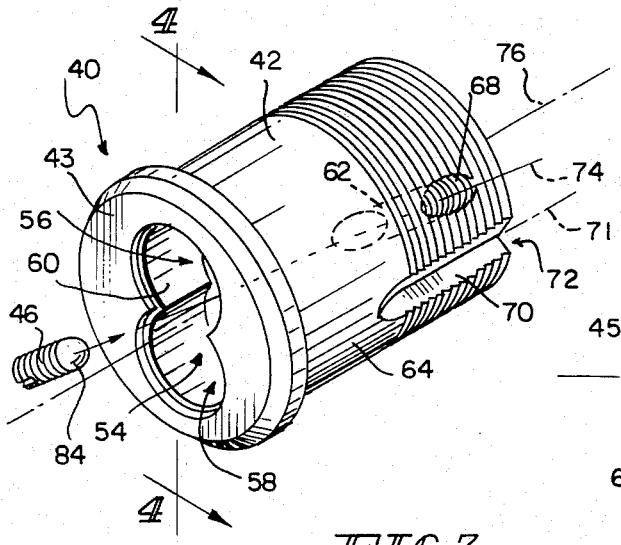
FIG. 3 is a perspective view of the cylinder lock assembly shown in FIG. 2 showing the circumferentially spaced-apart relation of the exterior bore opening and a channel opening.
Figure 4:
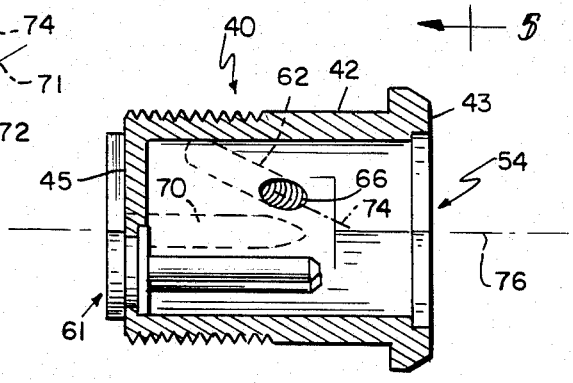
FIG. 4 is longitudinal sectional view of the invention of FIG. 2 taken generally along the lines 4—4 of FIG. 3.
Figure 5:
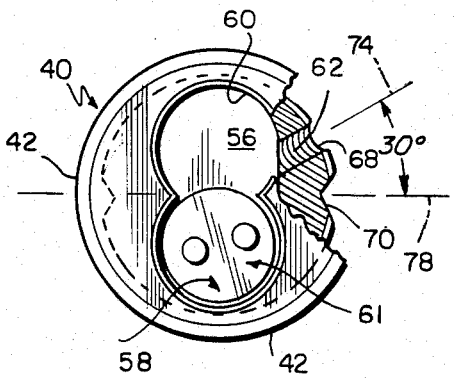
FIG. 5 is a transverse sectional view of the invention of FIG. 2 taken generally along the lines 5—5 of FIG. 4.
Figure 6:
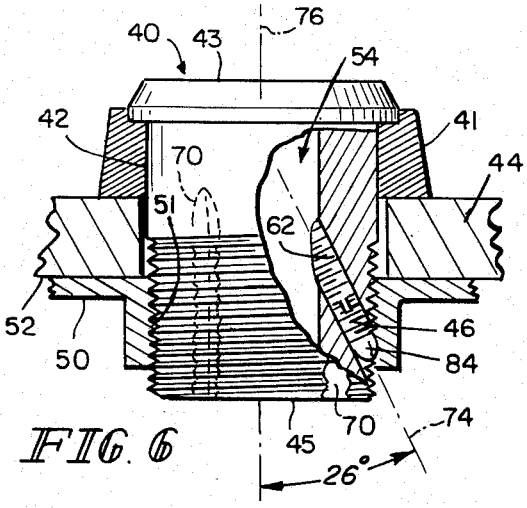
FIG. 6 is a side elevation view of the invention of FIG. 2, with portions broken away, showing the locking engagement of a cylinder-anchoring hidden setscrew and a lock case.

The improved lock cylinder 40 of the present invention is illustrated in FIGS. 2–6 and includes a lock body 42 mountable in a frame such as door 44 by means of a cylinder-anchoring hidden setscrew 46 and a rotation-blocking side setscrew 48 rotatably mounted in a mounting fixture 49. A cylinder ring 41 is positioned between the door 44 and the lock body 42 as shown in FIGS. 2 and 6. The lock body 42 includes a front face 43 and a rear face 45. It will be appreciated that lock cylinder 40 can also be mounted in any suitable lock case such as a mortise lock case (not shown). A lock case fixture 50 having a threaded passageway 51 or the like can be secured rigidly to an inner face 52 of the door 44 for the threaded reception of lock body 42. The lock body 42 is formed to include a cavity 54 for the reception of an interchangeable lock core (not shown). Illustratively, cavity 54 is shaped to receive an interchangeable lock core of figure-8 cross section, and as such, includes an upper lobe chamber 56 and a lower lobe chamber 58 as shown best in FIGS. 3 and 5. The upper lobe chamber 56 is defined in part by a contoured interior side wall 60. A throw member assembly 61 is attachable to the lock body 42 as shown in FIGS. 2, 4, and 5 in a known manner to permit actuation of the remainder of the lock mechanism (not shown) mounted in the door 44.

Figure 1:
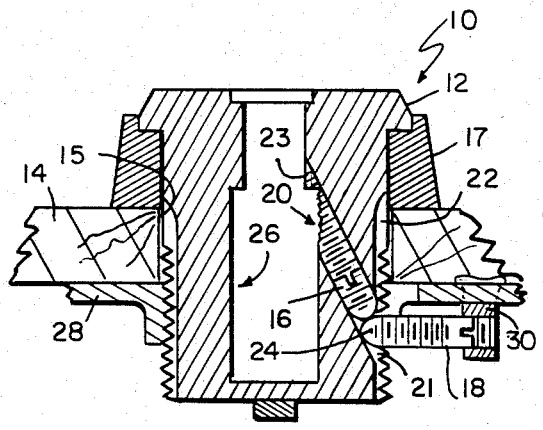
PRIOR ART FIG. 1
FIG. 1 is a sectional view of one type of conventional lock cylinder assembly.

The lock body 42 is formed to include a bore 62 extending between the lock body cavity 54 and an exterior side wall 64 of lock body 42. The bore 62 has an inner opening 66 in the interior side wall 60 of the upper lobe chamber 56 and an outer opening 68 in the exterior side wall 64 as shown best in FIGS. 2 and 3. Conveniently, the bore 62 is tapped to receive threadedly the hidden setscrew 46. The lock body 42 is also formed to include an elongated channel 70 having a longitudinal axis 71 and an opening 72 in the exterior side wall 64 for the reception of the side setscrew 48. Importantly, the outer bore opening 68 and each channel opening 72 are circumferentially spaced-apart about the exterior side wall 64 of the lock body 12 as shown best in FIGS. 2 and 3 and are not merged to communicate with one another as shown in the prior art lock cylinder 10 illustrated in FIG. 1. One advantage of the present invention is that it is easier to manufacture than the conventional lock cylinder assembly shown in FIG. 1 since the drill bit (not shown) used to form bore 62 intercepts the exterior side wall 64 of the lock body 42 rather than a side wall of the channel 70 to avoid the difficulty encountered in properly positioning the drill bit to obtain accurate placement of the outer bore opening 68.

A preferred orientation of bore 62 is illustrated and defined in FIGS. 5 and 6 to permit convenient assembly and operation of the hidden setscrew 46 as will be described below. The bore 62 has a longitudinal axis 74 as shown in FIGS. 3–6. It is helpful first to describe a reference plane and reference lines which are then usable to define precisely the location of the longitudinal axis 74 of the bore 62. A longitudinal central axis 76 of the lock body cavity 54 is shown in FIG. 3. A reference plane 78 is defined at the intersection of the upper lobe chamber 56 and the lower lobe chamber 58 as shown in FIG. 5. The longitudinal bore axis 74 and the first reference plane 78 cooperate to define therebetween a first angle of about 30° as shown in FIG. 5. Further, the longitudinal bore axis 74 and the second longitudinal central axis 76 cooperate to define therebetween a second angle of about 26° as shown in FIG. 6. Thus, the bore 62 is oriented at a compound angle in relation to an interchangeable lock core (not shown) that is installable in the lock body cavity 54. Also, the bore 62 is formed in the lock body 42 to cause the longitudinal bore axis 74 to be in skewed, non-intersecting relation to the longitudinal axis 71 of the channel 70 as shown best in FIG. 3.

The improved lock cylinder assembly of the present invention is assembled in the following manner. The lock body 42 is threadedly received in the threaded passageway 51 of lock case fixture 50 and rotated to a preferred operating position based on the hand of the lock. The side setscrew 48 is rotated to cause its forward tip 82 to intercept the channel 70 thereby to engage lock body 42 and block rotation of the lock body 42 in relation to the door 44, the lock case fixture 50, and the remainder of the lock mechanism (not shown). The hidden setscrew 46 is then inserted into bore 62 through the inner bore opening 66 as shown in FIG. 3 after first using a control key to remove an interchangeable lock core (not shown) from its position within the lock body cavity 54. The hidden setscrew 46 is then rotated using a tool to cause the forward tip 84 of the hidden setscrew 46 to engage lockingly the threaded passageway 51 of lock case fixture 50 thereby to attach rigidly the lock cylinder 40 to lock case fixture mounted in door 44.

Although the invention has been described in detail with reference to certain preferred embodiments and specific examples, variations and modifications exist within the scope and spirit of the invention as described and defined in the following claims.

What is claimed is:

1. A lock cylinder assembly of the type mountable in a lock case, the assembly comprising a lock body including an exterior side wall, the lock body being formed to include a cavity for the reception of an interchangeable lock core, at least one channel having a, side setscrew-receiving opening in the exterior side wall, and a bore extending between the lock body cavity and the exterior side wall to define a hidden setscrew-receiving opening in the exterior side wall, a side setscrew in the at least one channel and movable therein to block rotation of the lock cylinder assembly in relation to the lock case, and a hidden setscrew in the bore and movable therein to anchor the lock cylinder assembly in its mounted position in the lock case, the opening of each channel being situated in spaced-apart relation to the bore opening on the exterior side wall so that the side setscrew is movable in the at least one channel to its rotation-blocking position without entering the spaced-apart bore.

2. The lock cylinder assembly of claim 1, wherein the channel formed in the lock body is elongate and has a longitudinal axis, and the bore formed in the lock body includes a longitudinal axis in skewed non-intersecting relation to the longitudinal axis of the channel.

3. The lock cylinder assembly of claim 1, wherein the hidden setscrew is advanceable through the bore to engage the lock case thereby to anchor the lock cylinder assembly in its mounted position.

4. The lock cylinder assembly of claim 1, wherein the cavity formed in the lock body is shaped to receive a lock core of figure-8 cross-section, and includes an upper lobe chamber and a lower lobe chamber, said lobe chambers intersecting to define a reference plane therebetween, and the bore formed in the lock body includes a longitudinal axis, the bore being oriented in relation to the lock body to cause the longitudinal bore axis and the reference plane to define cooperatively a first angle therebetween and to cause the longitudinal bore axis and the longitudinal axis of the lock body cavity to define cooperatively a second angle therebetween.

5. The lock cylinder assembly of claim 4, wherein the first angle is about 30° and the second angle is about 26°.

6. A lock cylinder assembly mountable in a lock case or the like, the lock cylinder assembly comprising a lock body including a front face, a rear face, and a cylindrically-shaped exterior side wall extending therebetween, the lock body being formed to include a cavity having an opening in the forward face for the reception of an interchangeable lock core, at least one elongate channel having a side setscrew-receiving opening in the exterior side wall, and a bore having one of its opening in communication with the lock body cavity and the other of its openings in the cylindrically-shaped exterior side wall in circumferentially spaced relation to the opening of each channel, and a side setscrew in the at least one elongate channel and movable therein to block rotation of the lock cylinder assembly in relation to the lock case.

7. The lock cylinder assembly of claim 6, further comprising a hidden setscrew threadably received in the bore and advanceable through the exterior side wall bore opening to engage the lock case at a point in spaced relation to said side setscrew to lock the lock cylinder assembly in its mounted position in the lock case, whereby a lock core is removable from the lock body cavity to expose the interior bore opening to provide access to said hidden setscrew for the purpose of demounting the lock cylinder assembly by retracting the hidden setscrew into the lock body to disengage the lock case.

8. The lock cylinder assembly of claim 6, wherein the elongate channel formed in the lock body has a longitudinal axis, and the bore formed in the lock body includes a longitudinal axis in skewed non-intersecting relation to the longitudinal axis of the channel.

9. The lock cylinder of claim 6, wherein the cavity formed in the lock body is shaped to receive a lock core of FIG. 8 cross-section, and includes an upper lobe chamber and a lower lobe chamber, said lobe chambers intersecting to define a reference plane therebetween, and the bore formed in the lock body includes a longitudinal axis, the bore being oriented in relation to the lock body to cause the longitudinal bore axis and the reference plane to define cooperatively a first angle therebetween and to cause the longitudinal bore axis and the longitudinal axis of the lock body cavity to define cooperatively a second angle therebetween.

10. The lock cylinder assembly of claim 9, wherein the first angle is about 30° and the second angle is about 26°.

11. A lock cylinder assembly mountable in a lock case, the lock cylinder assembly comprising a lock body including an exterior side wall, the lock body being formed to include a cavity for the reception of an interchangeable lock core, an elongated channel having a longitudinal axis and a side setscrew-receiving opening in the exterior side wall, and a bore extending between the lock body cavity and the exterior side wall to define a hidden setscrew-receiving opening in the exterior side wall, a side setscrew in the at least one channel and movable therein to block rotation of the lock cylinder assembly in relation to the lock case, and a hidden setscrew in the bore and movable therein to anchor the lock cylinder assembly in its mounted position in the lock case, the hidden setscrew-receiving opening and each side setscrew-receiving opening being situated in spaced-apart relation on the exterior side wall, the bore having a longitudinal axis in skewed non-intersecting relation to the longitudinal axis of the channel.

12. The lock cylinder assembly of claim 11, wherein the hidden setscrew is advanceable through the bore to engage the lock case thereby to anchor the lock cylinder assembly in its mounted position.

13. The lock cylinder assembly of claim 11, wherein the cavity formed in the lock body is shaped to

14. The lock cylinder assembly of claim 11, wherein the first angle is about 30° and the second angle is about 26°.

* * * * *